US008334834B2

(12) United States Patent
Chen

(10) Patent No.: US 8,334,834 B2
(45) Date of Patent: Dec. 18, 2012

(54) BACKLIGHT CONTROL SYSTEM AND METHOD

(75) Inventor: Shing-Chia Chen, Tainan (TW)

(73) Assignee: Himax Media Solutions, Inc., Tainan County (TW)

( * ) Notice: Subject to any disclaimer, the term of this patent is extended or adjusted under 35 U.S.C. 154(b) by 802 days.

(21) Appl. No.: 12/242,702

(22) Filed: Sep. 30, 2008

(65) Prior Publication Data

US 2010/0079504 A1 Apr. 1, 2010

(51) Int. Cl.
*G09G 3/36* (2006.01)

(52) U.S. Cl. ..... 345/102; 345/690

(58) Field of Classification Search ..... 345/102, 345/211, 98, 89, 690; 348/687
See application file for complete search history.

(56) References Cited

U.S. PATENT DOCUMENTS

| | | | | |
|---|---|---|---|---|
| 7,466,297 | B2 * | 12/2008 | Pai | 345/89 |
| 2006/0038809 | A1 * | 2/2006 | Kuo et al. | 345/211 |
| 2007/0120807 | A1 * | 5/2007 | Bai et al. | 345/102 |
| 2007/0126678 | A1 * | 6/2007 | Shih et al. | 345/89 |
| 2007/0146299 | A1 * | 6/2007 | Kim et al. | 345/102 |
| 2007/0268242 | A1 * | 11/2007 | Baba et al. | 345/102 |
| 2008/0042968 | A1 * | 2/2008 | Oh | 345/102 |

* cited by examiner

*Primary Examiner* — Yong H Sim
(74) *Attorney, Agent, or Firm* — Stout, Uxa, Buyan & Mullins, LLP

(57) ABSTRACT

A backlight control system and method are disclosed. An overdrive device modifies a backlight duty signal according to a current-frame backlight duty signal and a previous-frame backlight duty signal. In one embodiment, the overdrive device is implemented with a lookup table that outputs the modified backlight duty signal. The backlight driven by the modified backlight duty signal then emits light to a display panel, thereby increasing a response time of the backlight.

12 Claims, 2 Drawing Sheets

BACKLIGHT CONTROL SYSTEM AND METHOD

BACKGROUND OF THE INVENTION

1. Field of the Invention

The present invention generally relates to backlight control, and more particularly to a backlight control system and method using an overdrive lookup table.

2. Description of the Prior Art

Backlight is used to illuminate a flat panel display, such as a liquid crystal display (LCD), from the back or side of the flat panel display. The light source may be a cold cathode fluorescent lamp (CCFL), a light-emitting diode (LED) or another light source.

A constant backlight is the backlight that outputs even and constant light no matter how the image data or the ambient light has been changed. The constant backlight approach has poor dynamic contrast. In order to increase the contrast, a dynamic backlight (DBL) is thus disclosed to dynamically or adaptively adjust (overall or respective portions of) the backlight brightness in accordance with image data distribution.

Nevertheless, a normal cold cathode fluorescent lamp (CCFL) has a low response time. In other words, the CCFL requires a period of time to reach target brightness, and therefore the change of brightness of the backlight usually lags behind changes in the backlight driving signal, such as a pulse-width-modulation (PWM) duty signal. The low response-time problem may only be solved by replacing the normal but low-price CCFL with a fast-response but expensive CCFL. However, such solution is not practical to mass production considering the cost and the acceptance of general users.

For the reason that conventional backlight, particularly the dynamic backlight, could not effectively respond conforming to the requirement, a need has arisen to propose a novel dynamic backlight control scheme having faster response time without sacrificing the cost.

SUMMARY OF THE INVENTION

In view of the foregoing, it is an object of the present invention to provide a backlight control system and method that increases response time without substantially increasing the cost.

According to one embodiment, an overdrive device modifies a backlight duty signal according to a current-frame backlight duty signal and a previous-frame backlight duty signal. In the embodiment, the overdrive device is implemented by a lookup table that outputs the modified backlight duty signal. The backlight driven by the modified backlight duty signal then emits light to a display panel, thereby increasing response time of the backlight.

DETAILED DESCRIPTION OF THE INVENTION

Figure 1:
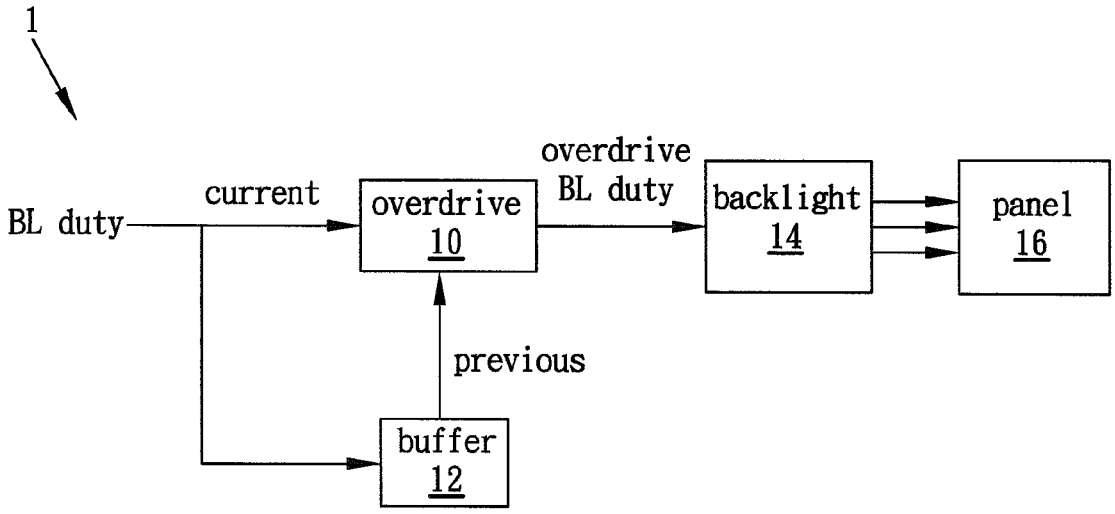
FIG. 1 illustrates a dynamic backlight overdrive control system according to one embodiment of the present invention.
Figure 2:
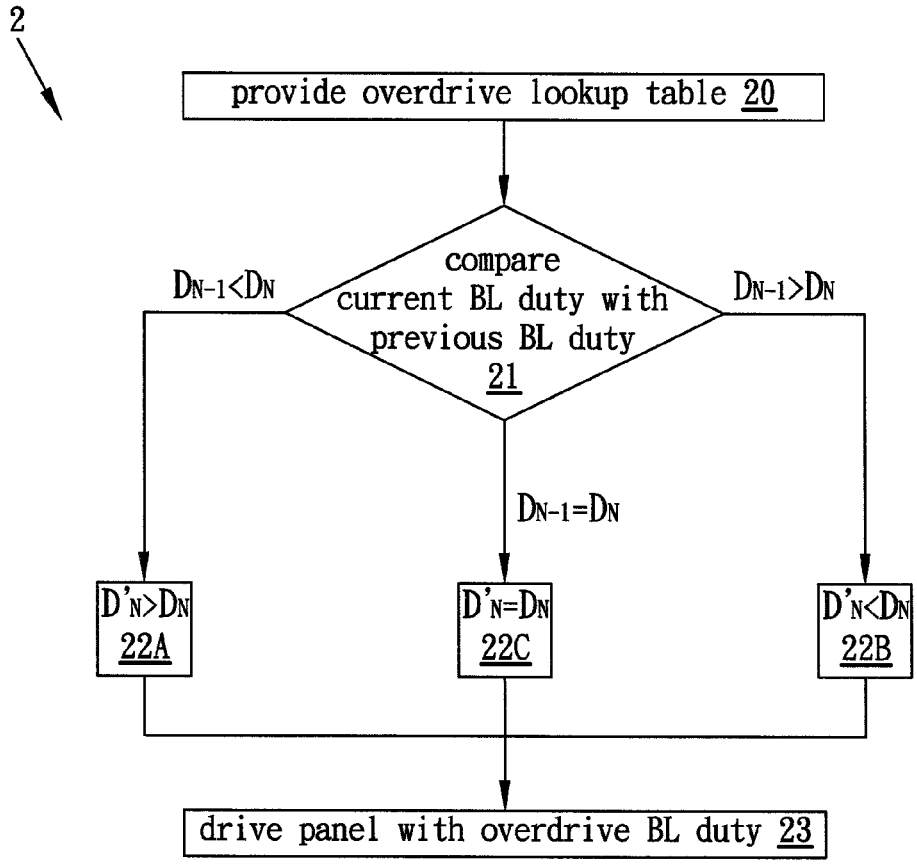
FIG. 2 illustrates a dynamic backlight overdrive control method according to the embodiment of the present invention.

FIG. 1 illustrates a dynamic backlight overdrive control system 1 according to one embodiment of the present invention. FIG. 2 illustrates a dynamic backlight overdrive control method 2 according to the embodiment of the present invention. Due to the low-speed light source, such as one or more of a cold cathode fluorescent lamp (CCFL), a low-speed light-emitting diode (LED), and some other low-end light source, an overdrive device 10 is utilized, in the embodiment, to accelerate the overall response time of the backlight control system 1. The overdrive device 10 may be implemented by one or more of a hardware circuit and a software program.

In the illustrated embodiment, a lookup table, such as exemplified in, but not limited to, the following Table 1 is provided (step 20). The lookup table may comprise, for example, an overdrive table that outputs an overdrive backlight duty signal (BL duty) based on a current backlight duty signal and a previous backlight duty signal, which is provided by and stored in a buffer 12. The backlight duty signal (BL duty) may be a pulse-width-modulation (PWM) signal with a pulse width proportional to the required backlight illumination.

In Table 1, the vertical axis represents the previous-frame backlight duty signal, and the horizontal axis represents the current-frame backlight duty signal. The values shown in Table 1 are provided by way of example, but not limitation, for an eight-bit system. Each value shown in Table 1 corresponds a duty cycle equal to "value/255". For example, the value "59" in the table corresponds to a duty cycle, such as a backlight PWM duty cycle, of 23% (=59/255).

TABLE 1

| | curr. | | | | | | | | |
|---|---|---|---|---|---|---|---|---|---|
| prev. | 0 | 32 | 64 | 96 | 128 | 160 | 192 | 224 | 255 |
| 0 | 0 | 75 | 145 | 168 | 186 | 202 | 222 | 241 | 255 |
| 32 | 0 | 32 | 97 | 135 | 163 | 190 | 215 | 238 | 255 |
| 64 | 0 | 10 | 64 | 111 | 148 | 180 | 208 | 235 | 255 |
| 96 | 0 | 6 | 50 | 96 | 138 | 174 | 204 | 233 | 255 |
| 128 | 0 | 3 | 39 | 83 | 128 | 167 | 167 | 200 | 255 |
| 160 | 0 | 2 | 30 | 71 | 116 | 160 | 196 | 229 | 255 |
| 192 | 0 | 1 | 21 | 59 | 107 | 152 | 192 | 227 | 255 |
| 224 | 0 | 1 | 14 | 48 | 93 | 143 | 186 | 224 | 255 |
| 255 | 0 | 0 | 9 | 34 | 75 | 129 | 166 | 219 | 255 |

Figure 3:
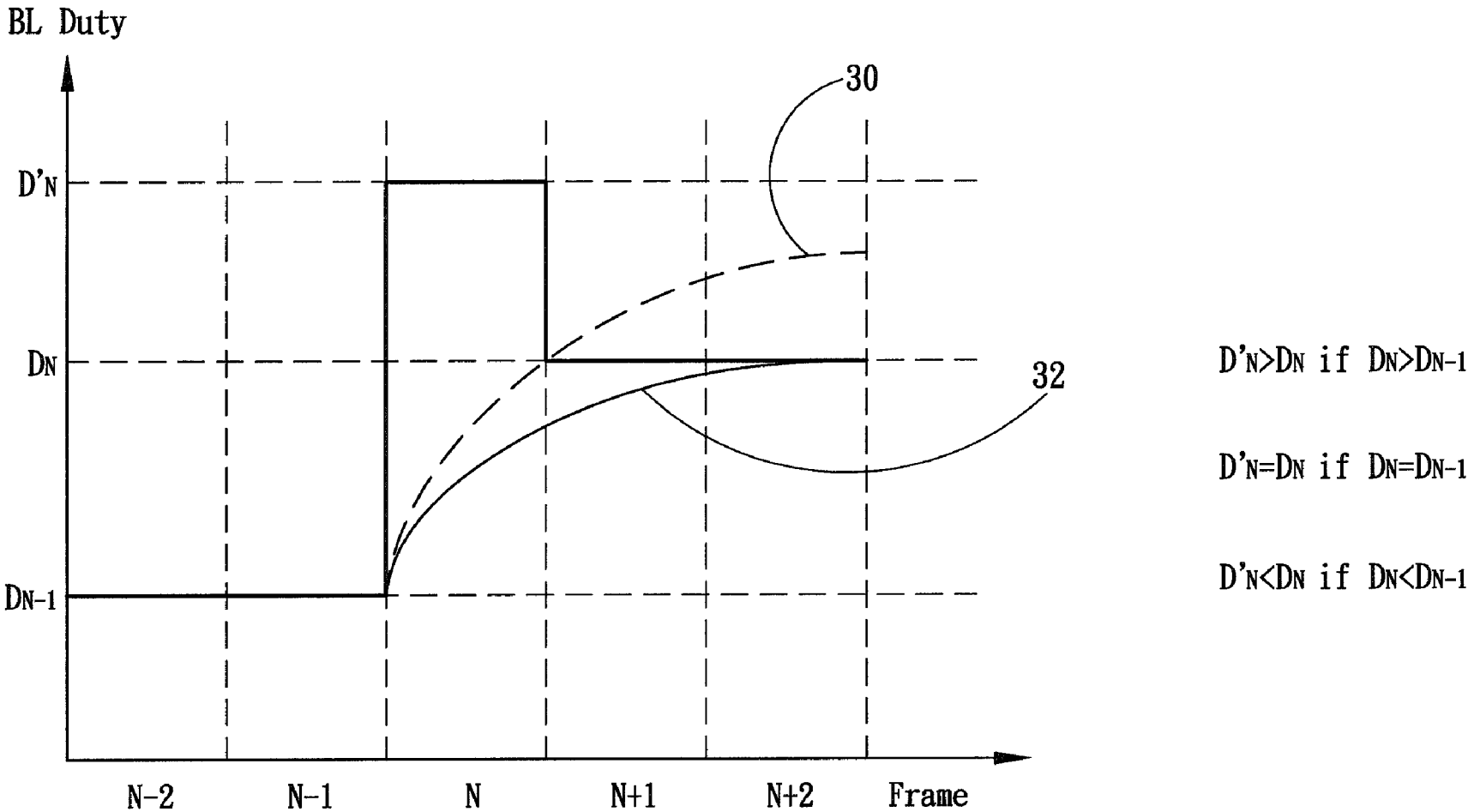
FIG. 3 shows an exemplary waveform of the backlight duty signal.

The current-frame backlight duty is compared with the previous-frame backlight duty (step 21), and the corresponding output of the overdrive table is the overdrive backlight duty. FIG. 3 shows an exemplary waveform of the backlight duty signal, where N represents the current frame and N−1 represents the previous frame, and $D_{N-1}/D_N/D'$ represents the magnitude of the backlight duty signal. In a case where the previous-frame backlight duty is smaller than the current-frame backlight duty (i.e., $D_{N-1}<D_N$), a magnitude $D'_N$ greater than the expected $D_N$ is thus retrieved as the output overdrive backlight duty (step 22A). For example, if the previous-frame backlight duty is "32" and the current-frame backlight duty is "64", as "32"<"64", the backlight duty "97" is thus retrieved from the overdrive lookup table in Table 1 as the output overdrive backlight. Accordingly, as shown in FIG. 3, the resulting response waveform 30 with use of the overdriving has a faster response than the response waveform 32 without use of the overdriving.

In a case where the previous-frame backlight duty is greater than the current-frame backlight duty (i.e., $D_{N-1}>D_N$), a magnitude $D'_N$ smaller than the expected $D_N$ is thus retrieved as the output overdrive backlight duty (step 22B). When the previous-frame backlight duty is equal or approximately equal to the current-frame backlight duty (i.e., $D_{N-1}=D_N$), a magnitude $D'_N$ the same as the expected $D_N$ is thus retrieved as the output overdrive backlight duty (step 22C).

The generated overdrive backlight duty signal is then fed to a backlight or backlight module 14 to dynamically control the on and off of the light emitting elements, such as a cold cathode fluorescent lamp (CCFL), low-speed light-emitting diode (LED) or other light source in the backlight 14. The backlight 14 accordingly provides the emitted light to a display panel 16 (step 23).

According to the described embodiment of the present invention, the dynamic backlight 14 has a response time that is faster than a conventional backlight without overdriving. The present invention thus provides means for mass producing a backlight, particularly, a dynamic backlight, that possesses a faster response time without a commensurate increase in cost.

Although specific embodiments have been illustrated and described, it will be appreciated by those skilled in the art that various modifications may be made without departing from the scope of the present invention, which is intended to be limited solely by the appended claims.

What is claimed is:

1. A backlight control system, comprising:

a backlight that emits light to a display panel; and an overdrive device that modifies a backlight duty signal according to a current-frame backlight duty signal and a previous-frame backlight duty signal, therefore increasing response time of the backlight driven by the modified backlight duty signal;

wherein the overdrive device compares a duty value of the current-frame backlight duty signal with a duty value of the previous-frame backlight duty signal;

wherein when the duty value of the previous-frame backlight duty signal is smaller than the duty value of the current-frame backlight duty signal, the modified backlight duty signal is generated with a magnitude greater than that of the current-frame backlight duty signal and applied to the backlight;

wherein when the duty value of the previous-frame backlight duty signal is greater than the duty value of the current-frame backlight duty signal, the modified backlight duty signal is generated with a magnitude smaller than that of the current-frame backlight duty signal and applied to the backlight; and wherein when the duty value of the previous-frame backlight duty signal is about equal to the duty value of the current-frame backlight duty signal, the modified backlight duty signal is generated with a magnitude about equal to that of the current-frame backlight duty signal and applied to the backlight.

2. The system of claim 1, wherein the overdrive device includes a lookup table which outputs the modified backlight duty signal.

3. The system of claim 2, wherein the lookup table has an axis representing the previous-frame backlight duty signal, and another axis representing the current-frame backlight duty signal.

4. The system of claim 1, wherein the backlight duty signal is a pulse-width-modulation (PWM) signal with a pulse width proportional to a required illumination of the backlight.

5. The system of claim 1, further comprising a buffer for storing and providing the previous-frame backlight duty signal.

6. The system of claim 1, wherein the backlight comprises a plurality of cold cathode fluorescent lamps (CCFL), a plurality of light-emitting diodes (LED), or a combination thereof.

7. A backlight control method, comprising:

modifying a backlight duty signal according to a current-frame backlight duty signal and a previous-frame backlight duty signal, therefore increasing a response time of a backlight; and driving the backlight to emit light to a display panel according to the modified backlight duty signal;

wherein the step of modifying the backlight duty signal comprises:

comparing a duty value of the current-frame backlight duty signal with a duty value of the previous-frame backlight duty signal;

generating the modified backlight duty signal with a magnitude greater than that of the current-frame backlight duty signal and applying it to the backlight, when the duty value of the previous-frame backlight duty signal is smaller than the duty value of the current-frame backlight duty signal;

generating the modified backlight duty signal with a magnitude smaller than that of the current-frame backlight duty signal and applying it to the backlight, when the duty value of the previous-frame backlight duty signal is greater than the duty value of the current-frame backlight duty signal; and generating the modified backlight duty signal with a magnitude about equal to that of the current-frame backlight duty signal and applying it to the backlight, when the duty value of the previous-frame backlight duty signal is about equal to the duty value of the current-frame backlight duty signal.

8. The method of claim 7, further comprising providing a lookup table which outputs the modified backlight duty signal.

9. The method of claim 8, wherein the lookup table has an axis representing the previous-frame backlight duty signal, and another axis representing the current-frame backlight duty signal.

10. The method of claim 7, wherein the backlight duty signal is a pulse-width-modulation (PWM) signal with a pulse width proportional to a required illumination of the backlight.

11. The method of claim 7, further comprising storing and providing the previous-frame backlight duty signal.

12. The method of claim 7, wherein the backlight comprises cold cathode fluorescent lamps (CCFL) and/or light-emitting diodes (LED).

* * * * *